US010864749B2

(12) United States Patent
Yamauchi et al.

(10) Patent No.: US 10,864,749 B2
(45) Date of Patent: Dec. 15, 2020

(54) THERMAL PRINT HEAD AND THERMAL PRINTER

(71) Applicant: TOSHIBA HOKUTO ELECTRONICS CORPORATION, Asahikawa (JP)

(72) Inventors: Megumi Yamauchi, Asahikawa (JP); Seiichi Noro, Asahikawa (JP); Masakatsu Doi, Asahikawa (JP); Tsuyoshi Yamamoto, Asahikawa (JP); Yoshihide Abe, Asahikawa (JP); Tomonori Suzuki, Asahikawa (JP); Yuuki Komori, Asahikawa (JP)

(73) Assignee: Toshiba Hokuto Electronics Corporation, Asahikawa (JP)

( * ) Notice: Subject to any disclaimer, the term of this patent is extended or adjusted under 35 U.S.C. 154(b) by 0 days.

(21) Appl. No.: 16/213,115

(22) Filed: Dec. 7, 2018

(65) Prior Publication Data

US 2019/0193417 A1 Jun. 27, 2019

(30) Foreign Application Priority Data

Dec. 25, 2017 (JP) ..... 2017-247709

(51) Int. Cl.

| | |
|---|---|
| ***B41J 2/35*** | (2006.01) |
| ***B41J 2/355*** | (2006.01) |
| ***B41J 2/375*** | (2006.01) |
| ***B41J 2/335*** | (2006.01) |

(52) U.S. Cl.

CPC ..... *B41J 2/355* (2013.01); *B41J 2/3351* (2013.01); *B41J 2/3353* (2013.01); *B41J 2/3354* (2013.01); *B41J 2/3355* (2013.01); *B41J 2/3357* (2013.01); *B41J 2/33515* (2013.01); *B41J 2/33525* (2013.01); *B41J 2/375* (2013.01)

(58) Field of Classification Search

CPC ..... B41J 2/355; B41J 2/3553; B41J 2/3555; B41J 2/3556; B41J 2/3558; B41J 2/135; B41J 2/335; B41J 2/35; B41J 2/33525; B41J 2/33515; B41J 2/3351

See application file for complete search history.

(56) References Cited

U.S. PATENT DOCUMENTS

| | | | | |
|---|---|---|---|---|
| 5,359,351 A * | 10/1994 | Sato | B41J 2/345 347/209 |
| 8,742,258 B2 * | 6/2014 | Terashima | C22C 5/02 174/126.2 |
| 2007/0235887 A1 | 10/2007 | Kaimori et al. | |

FOREIGN PATENT DOCUMENTS

| | | |
|---|---|---|
| JP | 2005-167020 A1 | 6/2005 |
| JP | 2011-077254 A1 | 4/2011 |

* cited by examiner

*Primary Examiner* — Kristal Feggins
(74) *Attorney, Agent, or Firm* — Burr & Brown, PLLC

(57) ABSTRACT

According to one embodiment, a thermal print head includes a heat sink; a head substrate placed on the heat sink and having a plurality of heat generating elements arranged in a primary scanning direction; a circuit board placed on the heat sink so as to be adjacent to the head substrate in an auxiliary scanning direction and provided with a connection circuit; and a control element electrically connected to the heat generating element via a first bonding wire and electrically connected to the connection circuit via a second bonding wire, in which at least one of the first bonding wire and the second bonding wire includes any of a copper wire, a copper alloy wire, and a wire mainly made of copper and coated with a metal different from copper.

20 Claims, 11 Drawing Sheets

THERMAL PRINT HEAD AND THERMAL PRINTER

CROSS REFERENCE TO RELATED APPLICATION

This application is based upon and claims the benefit of priority from the prior Japanese Patent Applications No. 2017-247709, filed on Dec. 25, 2017, the entire contents of which are incorporated herein by reference.

BACKGROUND OF THE INVENTION

1. Field of the Invention

Embodiments described herein relate generally to a thermal print head and a thermal printer.

2. Description of Related Art

The thermal print head (TPH) is an output device that heats a plurality of resistors arrayed in a heat generation region to form an image such as characters and graphics on a thermal recording medium by the heat.

The thermal print head is widely used for recording apparatuses such as bar code printers, digital plate-making machines, video printers, imagers, and seal printers.

The thermal print head includes a heat sink, a head substrate provided on the heat sink, and a circuit board.

A glaze layer is provided on the head substrate, and a plurality of heat generating elements is provided on the glaze layer. A driving IC to control heat generation of the plurality of heat generating elements is mounted on the circuit board.

The plurality of heat generating elements and the driving IC are electrically connected to each other via a bonding wire.

A thermal printer includes a thermal print head and a platen roller. When printing, an image-receiving sheet is inserted into a gap between the thermal print head and the platen roller, and the platen roller presses the image-receiving sheet against the thermal print head. When the pressing pressure is high, the head substrate moves slightly repeatedly in accordance with the rotation of the platen roller.

As a result, in some cases, the bonding wire which connects the driving IC and the heat generating element may be fatigued and fractured.

DETAILED DESCRIPTION OF THE INVENTION

According to one embodiment, a thermal print head includes a heat sink, a head substrate having a support substrate placed on the heat sink, a glaze layer stacked on the support substrate, and a plurality of heat generating elements provided on the glaze layer and arranged in a primary scanning direction, a circuit board placed on the heat sink so as to be adjacent to the head substrate in an auxiliary scanning direction and provided with a connection circuit, and a control element electrically connected to the heat generating element via a first bonding wire and electrically connected to the connection circuit via a second bonding wire, in which at least one of the first bonding wire and the second bonding wire includes any of a copper wire, a copper alloy wire, and a wire mainly made of copper and coated with a metal different from copper.

Hereinafter, embodiments of the invention will be described with reference to the drawings.

First Embodiment

Figure 1A:
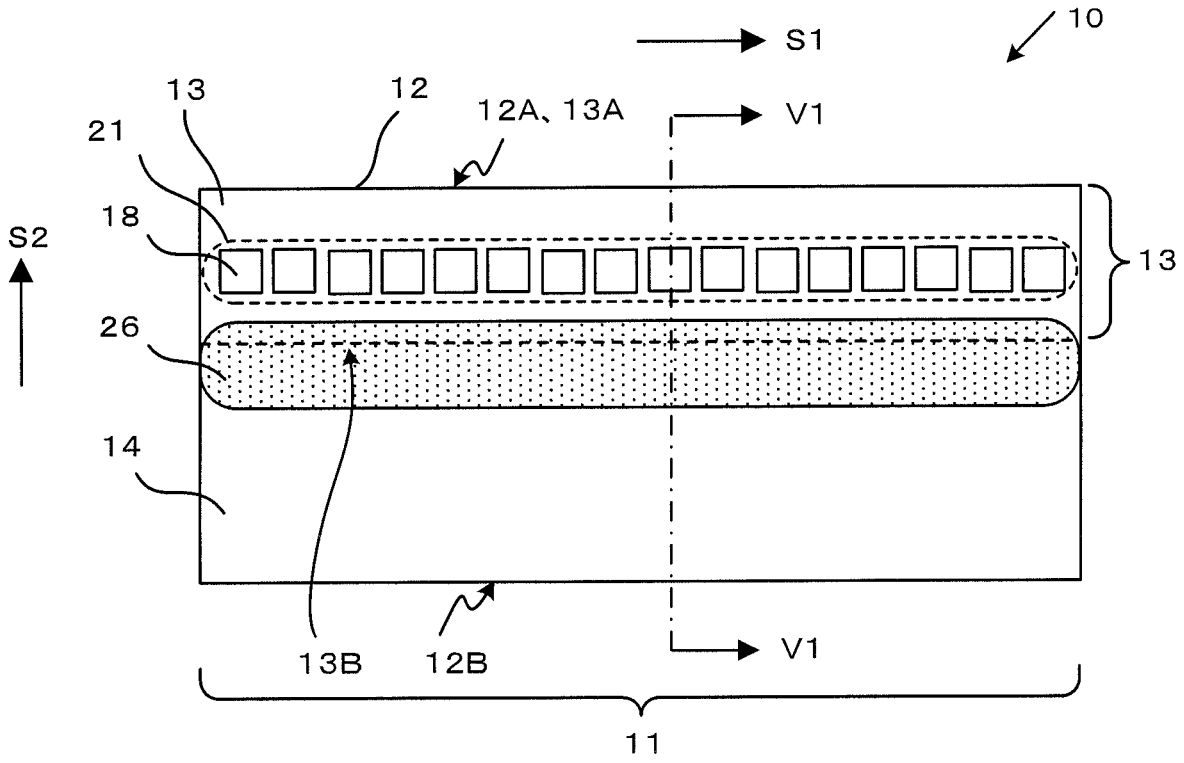
FIGS. 1A and 1B are diagrams illustrating a thermal print head according to a first embodiment.
Figure 1B:
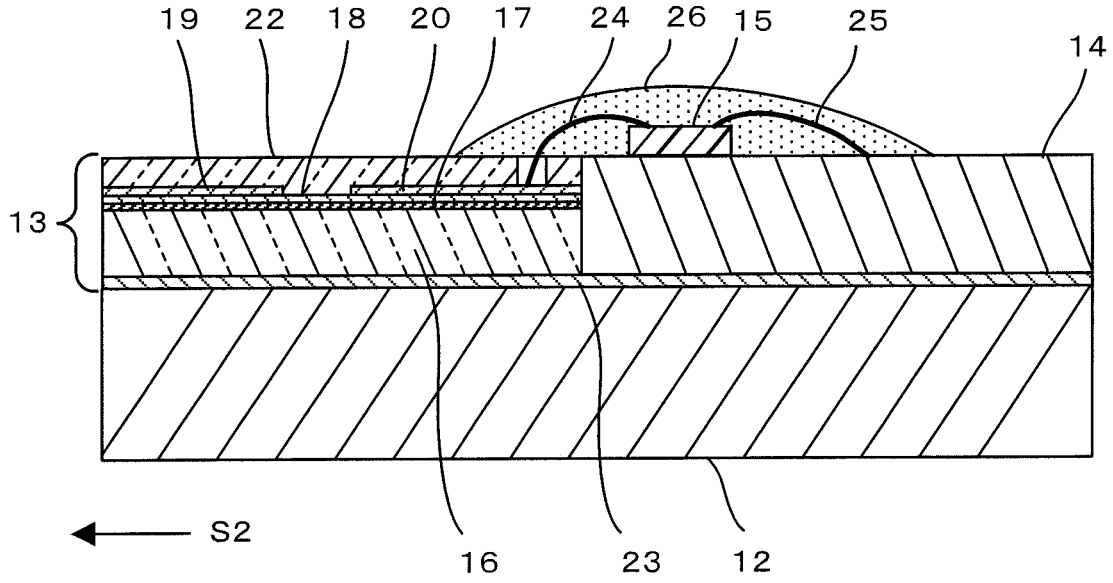
Figure 2A:
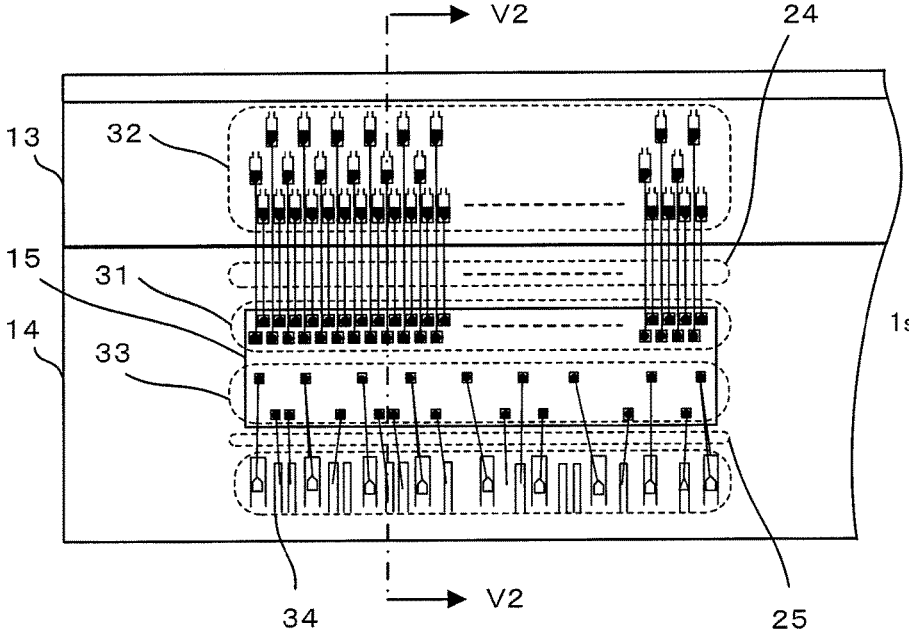
FIGS. 2A and 2B are diagrams illustrating an example of the arrangement of bonding wires of the thermal print head according to the first embodiment.
Figure 2B:
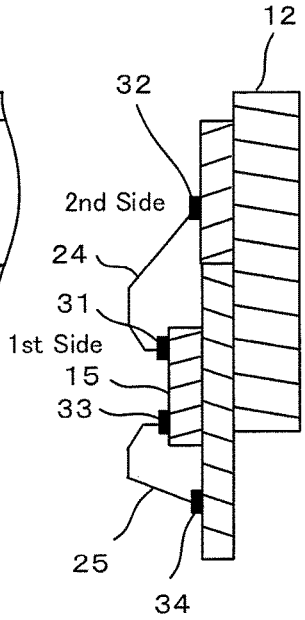
Figure 3:
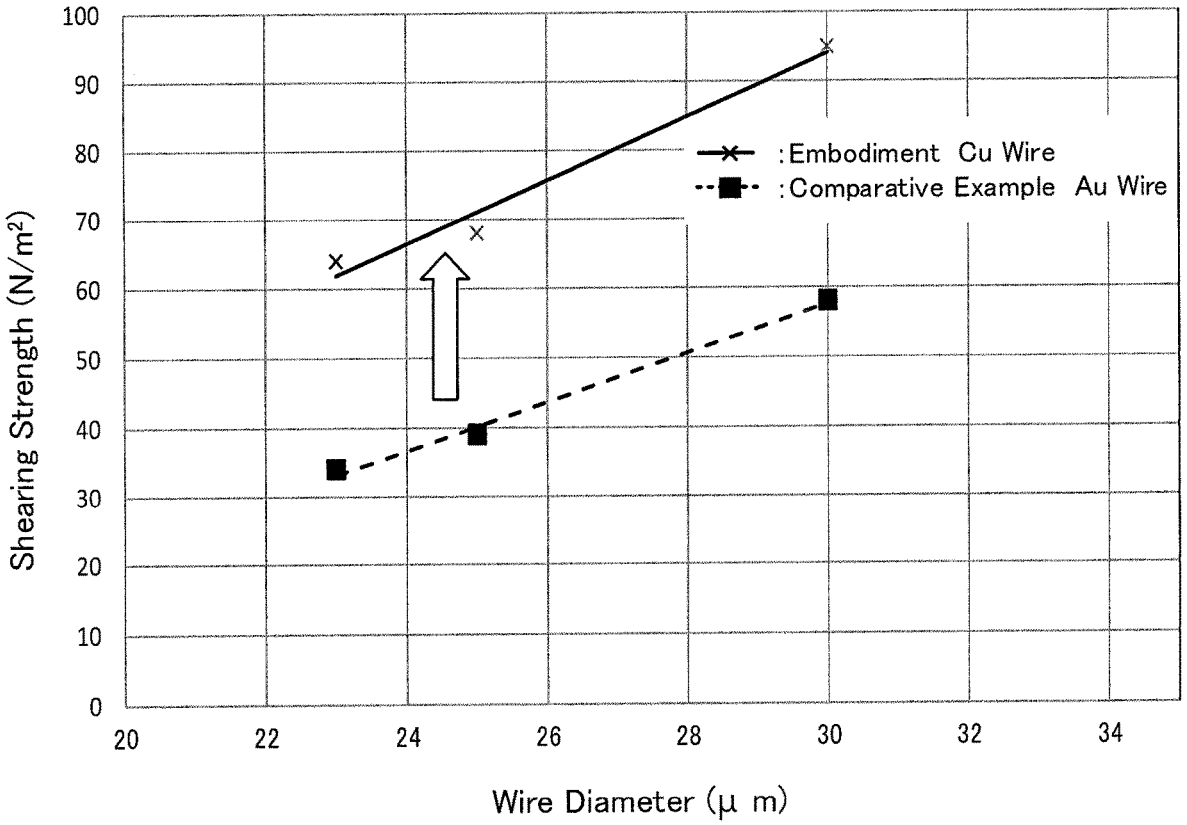
FIG. 3 is a view illustrating a relation between the diameter and the shearing strength of the bonding wire according to the first embodiment in comparison with a bonding wire of a comparative example.

A thermal print head according to the embodiment will be described with reference to FIGS. 1 to 3. FIGS. 1A and 1B are diagrams illustrating a thermal print head, FIG. 1A is a plan view of the thermal print head, and FIG. 1B is a cross-sectional view taken along the line V1-V1 of FIG. 1A and viewed in a direction of an arrow. FIGS. 2A and 2B are diagrams illustrating an arrangement example of bonding wires of the thermal print head, FIG. 2A is a plan view of the bonding wires, and FIG. 2B is a cross-sectional view taken along the line V2-V2 of FIG. 2A and viewed in a direction of an arrow. FIG. 3 is a photograph illustrating a main part of the arrangement example of the bonding wires.

The embodiment is merely an example, and the invention is not limited thereto. The drawings are schematic and ratios of each dimension and the like are different from actual ones.

First, the thermal print head will be described.

As illustrated in FIG. 1, the thermal print head 10 has an elongated head unit 11 that is long in a primary scanning direction S1 in which an image can be formed on a recording medium. The head unit 11 has a heat sink 12, a head substrate 13, a circuit board 14, and a plurality of driving ICs 15 (control elements).

The heat sink 12 is made of a metal such as aluminum or stainless steel with good heat dissipation properties. In the heat sink 12, a heat sink one end face 12A in an auxiliary scanning direction S2 orthogonal to the primary scanning direction S1, and a heat sink other end face 12B in a direction opposite to the auxiliary scanning direction S2 (hereinafter also referred to as an auxiliary scanning opposite direction) are substantially parallel, have a substantially uniform thickness, and are formed in a flat plate shape elongated in the primary scanning direction S1.

The other end portion of the heat sink in the auxiliary scanning opposite direction of the heat sink 12 serves as a circuit board placement portion in which the circuit board 14 is disposed, and is formed in a rectangular shape elongated in the primary scanning direction S1. Further, in the heat sink 12, the circuit board 14 and the head substrate 13 are disposed on one surface in order in the auxiliary scanning direction S2.

The head substrate 13 is long in the primary scanning direction S1, and a head substrate one end face 13A in the auxiliary scanning direction S2 and a head substrate other end face 138 in the auxiliary scanning opposite direction are substantially parallel to each other.

The head substrate 13 has a support substrate 16 formed in a rectangular parallelepiped shape by an insulator material having heat resistance, for example, ceramic such as $Al_2O_3$. An external shape of the support substrate 16 is an outer shape of the head substrate 13 as it is. The support substrate 16 may be SiN, SiC, quartz, AlN, or fine ceramics containing Si, Al, O, N, or the like.

On the support substrate 16, a glaze layer 17 made of a glass film such as $SiO_2$ is provided on one surface. The glaze layer 17 can be formed by printing a glass paste prepared by mixing glass powders with an organic solvent and baking the glass paste.

On one surface of the glaze layer 17, a plurality of heat generating resistors 18 elongated in the auxiliary scanning direction S2 is disposed in the primary scanning direction S1 in order at a predetermined inter-substrate resistor arrangement interval. Further, on one surface of the glaze layer 17, a common electrode 19 and an individual electrode 20 are disposed at both end portions of the plurality of heat generating resistors 18 along the auxiliary scanning direction S2, and a heat generating element is formed by the plurality of heat generating resistors 18, the common electrode 19, and the individual electrode 20. As a result, a strip-like portion of the head substrate 13 along the primary scanning direction S1 serves as a heat generating region 21 in which the plurality of heat generating resistors 18 generates heat between the common electrode 19 and the individual electrode 20.

A protective film 22 to cover the plurality of heat generating resistors 18, the common electrode 19, and the individual electrode 20 is formed on one surface of the glaze layer 17.

In FIG. 1A, as the plurality of heat generating resistors 18 disposed on the head substrate 13, an inter-resistor electrode portion forming the heat generating region 21 between the common electrode 19 and the individual electrode 20 is indicated by a solid line. Further, the head substrate 13 adheres to the heat sink 12 via an adhesive 23. The other surface of the support substrate 16 adheres to one surface of the head substrate arrangement portion of the heat sink 12 via the adhesive 23 which is a thermoplastic resin such as a double-sided tape or a silicone resin.

The circuit board 14 is formed as a printed wiring board elongated in the primary scanning direction S1 or is formed by affixing a flexible substrate to a ceramic plate or a glass epoxy resin (one obtained by impregnating an overlapped cloth made of glass fiber with epoxy resin) plate or the like elongated in the primary scanning direction S1. The other surface of the circuit board 14 adheres to one surface of the circuit board arrangement portion of the heat sink 12 via a double-sided tape or an adhesive 23.

A connection circuit (not illustrated) to be electrically connected to the head substrate 13 via a driving IC 15 is formed on the circuit board 14, and a connector (not illustrated) to input drive power and control signals to the connection circuit from the outside is mounted on the circuit board 14.

Each of the plurality of driving ICs 15 is a control element provided with a plurality of first terminals and a plurality of second terminals (not illustrated) on one surface and having a switching function capable of controlling the heat generating elements. The first terminal is an output side terminal, and the second terminal is an input side terminal. The plurality of driving ICs 15 is disposed in order in the primary scanning direction S1, for example, at one end portion in the auxiliary scanning direction S2 of one surface of the circuit board 14 (that is, a boundary portion with the head substrate 13).

In the plurality of driving ICs 15, a plurality of first terminals is electrically connected to the individual electrodes 20 via a plurality of bonding wires 24 (first bonding wires). Further, in the plurality of driving ICs 15, a plurality of second terminals is electrically connected to the corresponding substrate electrodes (not illustrated) formed on the connection circuit of the circuit board 14 via the plurality of bonding wires 25 (the second bonding wires).

The plurality of driving ICs 15 is sealed together with the plurality of bonding wires 24, 25 in the vicinity of a boundary between one surface of the head substrate 13 and one surface of the circuit board 14 by a sealing body 26.

Since the silicone resin has hardness lower than that of the epoxy resin, there is an advantage that the stress applied to a driving IC 15 is reduced compared with the epoxy resin. This is suitable for a case where excessive stress is not desired to be applied to the driving IC 15. This is a case where the driving IC 15 includes a reference voltage generation circuit or the like, for example.

The hardness of the resin is generally expressed by Rockwell hardness (hardness based on indentation depth), Shore hardness (hardness based on repulsion distance), or the like. The silicone resin has hardness lower than that of the epoxy resin at any hardness.

Next, a bonding wire which is a feature of the embodiment will be described. Hereinafter, the bonding wire may be simply referred to as a wire.

As illustrated in FIG. 2, the bonding wire 24 is connected to a bonding pad 31 of a first terminal on an output side of the driving IC 15, and a bonding pad 32 of the corresponding individual electrode 20. The bonding wire 25 is connected to a bonding pad 33 of a second terminal on an input side of the driving IC 15, and a bonding pad 34 of the corresponding substrate electrode formed in the connection circuit of the circuit board 14.

A plurality of bonding wires 24, 25 and a plurality of bonding pads 31 to 34 are provided, respectively.

The bonding wires 24, 25 are copper (Cu) wires. Besides the copper wire, the bonding wires 24, 25 may be a copper alloy wire or a metal wire containing copper as a main component.

The copper alloy wire is a copper wire in which a trace amount (a percentage or less) of impurities is added to pure copper (for example, purity 4 N, 99.99% or more). Examples of elements capable of being added include calcium (Ca), boron (B), phosphorus (P), aluminum (Al), silver (Ag), selenium (Se), and the like. It is expected that when these elements are added, high elongation characteristics are obtained and the strength of the bonding wire is further improved.

Further, beryllium (Be), tin (Sn), zinc (Zn), zirconium (Zr), silver (Ag), chromium (Cr), iron (Fe), oxygen (O), sulfur (S), hydrogen (H), and the like are exemplified. By containing 0.001 wt % or more of elements other than copper, high elongation characteristics are expected.

The metal wire containing copper as a main component is, for example, a copper wire subjected to palladium (Pd) plating and gold (Au) plating. The plating layers are provided to suppress the oxidation of copper.

The bonding pads 31 to 34 are, for example, metals containing aluminum (Al) as a main component. A metal containing aluminum (Al) as a main component is, for example, an alloy obtained by mixing Al with a several percent of silicon (Si).

For example, when a copper wire having a diameter of 23 μmϕ is used as the bonding wire 24 and the bonding wire 24 is bonded with a long span of 0.5 mm to 3 mm, bending of the bonding wire 24 was not observed. Linearity was better than that of gold (Au) wire commonly used as a bonding wire.

Since the linearity is excellent, even if a plurality of bonding wires 24 is arranged in parallel and the pitch is as narrow as 19 μm to 110 μm, there is no risk of contact between the bonding wires 24. The copper wire is suitable for high density bonding. The same also applies to the bonding wire 25. The bonding wires 24, 25 can have the same diameter.

Figure 4:
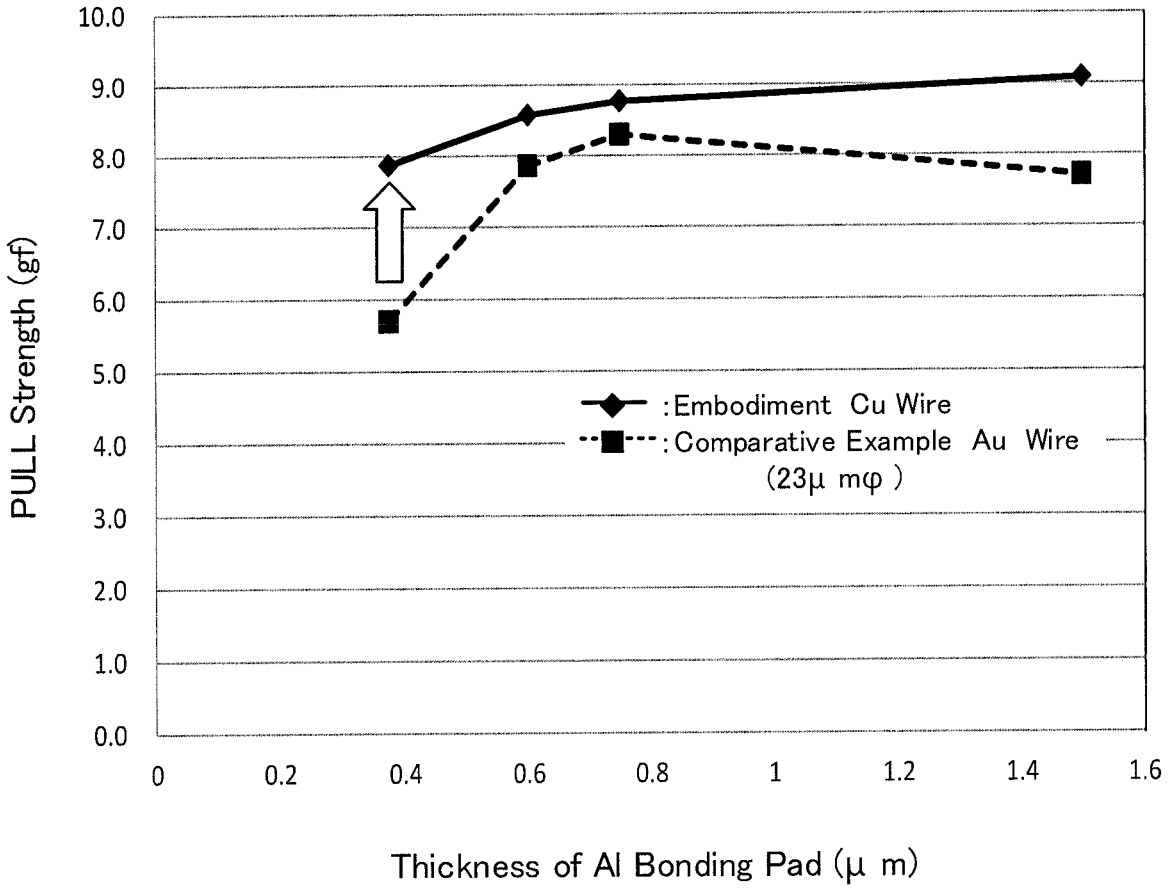
FIG. 4 is a view illustrating a relation between the PULL strength of the bonding wire and the thickness of a bonding pad according to the first embodiment in comparison with the bonding wire of the comparative example.
Figure 5:
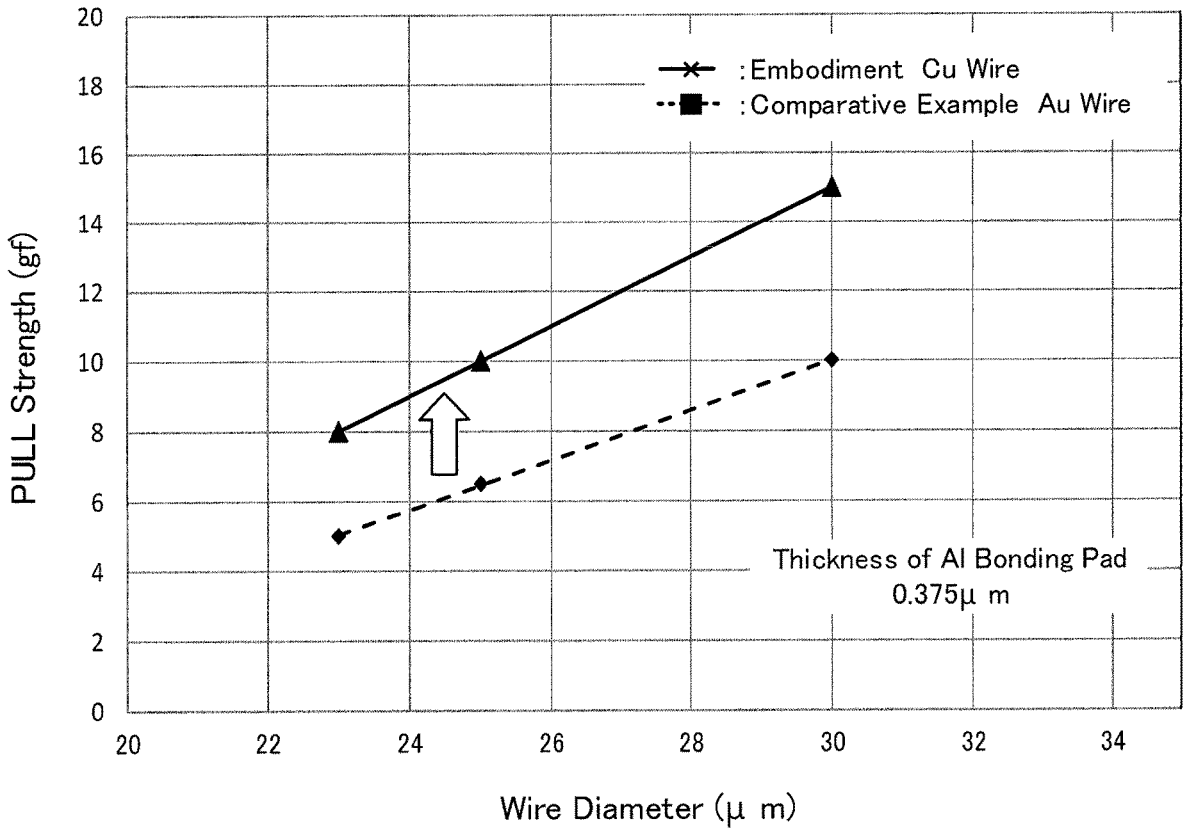
FIG. 5 is a view illustrating a relation between the diameter and the PULL strength of the bonding wire according to the first embodiment in comparison with the bonding wire of the comparative example.

With reference to FIGS. 3 to 5, the mechanical strength of a copper (Cu) wire as a bonding wire will be described in comparison with a bonding wire of a comparative example. The bonding wire of the comparative example is a gold (Au) wire commonly used as a bonding wire.

FIG. 3 is a view illustrating a relation between the diameter of the bonding wire and the shearing strength, a solid line shows the shearing strength of the copper wire, and a broken line shows the shearing strength of the gold wire. Here, the diameter of the wire was changed to 23 μmϕ, 25 μmϕ, and 30 μmϕ.

As illustrated in FIG. 3, with the gold wire, the shearing strength was 35 $N/m^2$, 39 $N/m^2$, and 58 $N/m^2$, respectively. On the other hand, with copper wire, shearing strength was 64 $N/m^2$, 68 $N/m^2$, and 95 $N/m^2$, respectively, higher than that of gold wire. These results indicate that the shearing strength of the copper wire is about 1.6 to 1.8 times higher than the shearing strength of the gold wire.

The term "shearing" means that a force is applied in a direction in which an object is cut, and the material is fractured. When a load is applied in the direction in which the object is cut, a shearing force tending to deviate works on the cross section of the material. When a force greater than the shearing strength of the material is applied, sliding occurs inside the material and the material is cut. The shearing strength is generally about a fraction of the compressive strength.

FIG. 4 is a view illustrating a relation between the PULL strength of the bonding wire and the thickness of the bonding pad, a solid line shows the PULL strength of the copper wire, and a broken line shows the PULL strength of the gold wire. Here, the wire diameter was 23 μmϕ, and the thickness of aluminum (Al) of the bonding pad was changed to 0.375 μm, 0.6 μm, 0.75 μm, and 1.5 μm.

In addition, the PULL strength is the load when the bonding wire is fractured by hooking a loop portion of the bonded wire and pulling the wire. Besides fracturing of the wires themselves, destruction modes include destruction of the bonding pad connecting portion of the bonding wire, destruction of the bonding wire neck portion, and the like.

As illustrated in FIG. 4, with the gold wire, the PULL strengths were 5.7 gf, 7.8 gf, 8.3 gf, and 7.7 gf, respectively, and in a region in which the Al film thickness was as thin as 0.375 μm, the PULL strength greatly decreased. On the other hand, with the copper wire, the PULL strength was 7.8 gf, 8.6 gf, 8.8 gf, 9.1 gf, respectively, higher than that of the gold wire, and the stable PULL strength against the Al film thickness of 0.375 μm to 1.5 μm was obtained. Basically, a fracture mode was a fracture of the wire itself, but the fracture mode of the gold wire when the Al film thickness was 0.375 μm was a fracture of the bonding pad connecting portion.

These results indicate that the PULL strength of the copper wire is equal to or higher than the PULL strength of the gold wire, and especially in the region in which the Al film thickness is as thin as 0.375 μm, the PULL strength of the copper wire is remarkably superior to the PULL strength of the gold wire. This is thought to be due to the bonding condition of the copper wire and the like as described later. Therefore, with the copper wire, it is possible to set the Al film thickness of the bonding pad to be thinner than that of the gold wire, and it can be said that there is a sufficient margin for the Al film thickness of the bonding pad.

FIG. 5 is a view illustrating a relation between the wire diameter of bonding and the PULL strength, a solid line shows the PULL strength of the copper wire, and a broken line shows the PULL strength of the gold wire. Here, the Al film thickness of the bonding pad was 0.375 μm, and the wire diameter was varied to 23 μmϕ, 25 μmϕ, and 30 μmϕ.

As illustrated in FIG. 5, with the gold wire, the PULL strength was 5 gf, 6.5 gf, and 10 gf, respectively. On the other hand, with the copper wire, the PULL strength was 8 gf, 10 gf, 15 gf, respectively, higher than that of the gold wire. These results indicate that the PULL strength of the copper wire is about 1.5 to 1.6 times higher than the PULL strength of the gold wire.

As described above, the PULL strength of the copper wire is equal to or higher than the PULL strength of the gold wire in response to the fact that the shearing strength of the copper wire is higher than the shearing strength of the gold wire. The bondability of the copper wire is not inferior to the bondability of the gold wire. Therefore, the copper wire can obtain higher reliability than that of the gold wire as the bonding wire.

Figure 6:
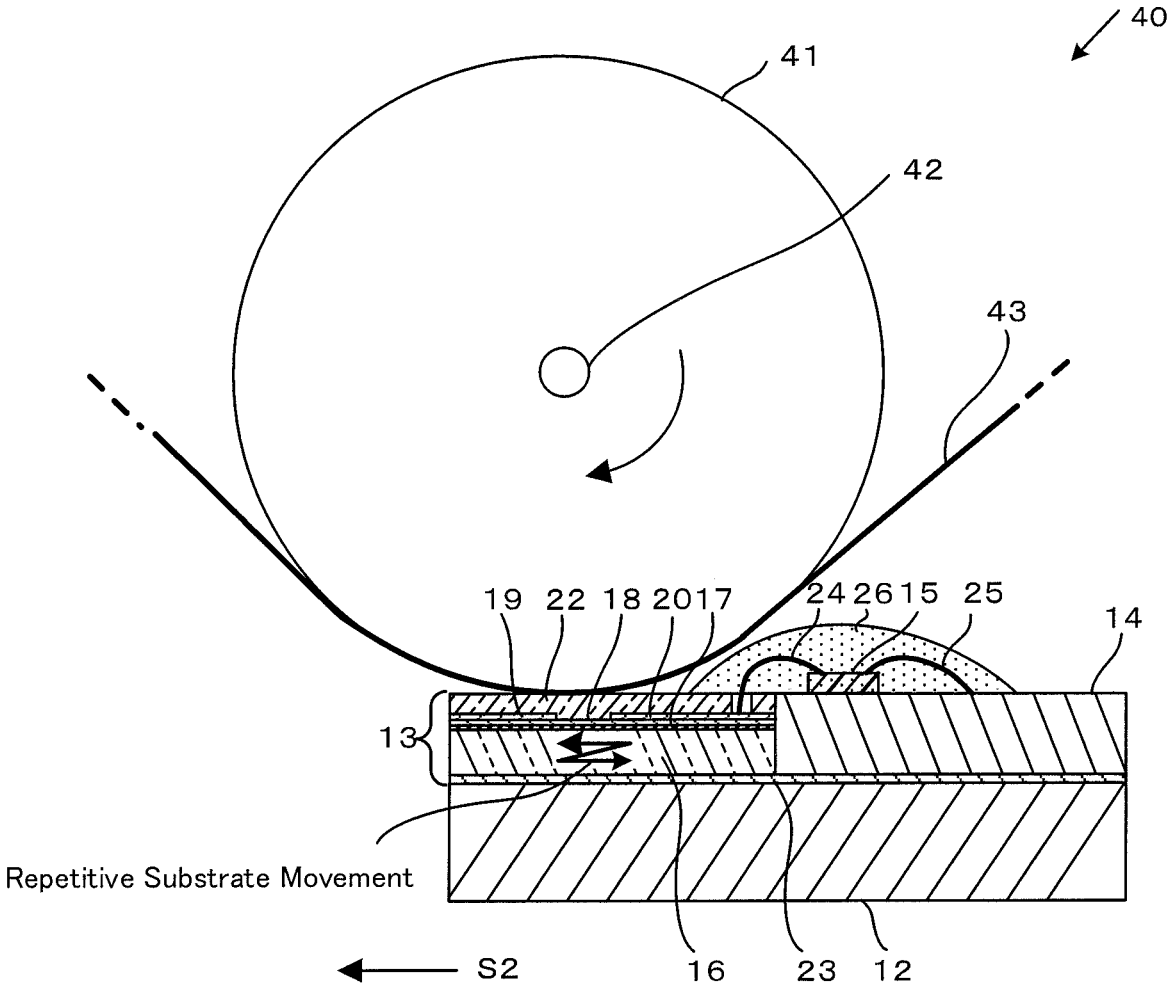
FIG. 6 is a cross-sectional view illustrating a thermal printer using the thermal print head according to the first embodiment.

Next, effects of using a copper wire as a bonding wire in a thermal print head will be described. FIG. 6 is a diagram illustrating a thermal printer using the thermal print head 10 of this embodiment.

As illustrated in FIG. 6, the thermal printer 40 includes a platen roller 41. The platen roller 41 is disposed such that a side surface comes into contact with a heat generation region (a belt-like region in which a plurality of heat generating resistors 18 is disposed) 21 with the primary scanning direction S1 as an axis, and is provided to be rotatable about the shaft 42.

The thermal printer 40 moves a thermal sheet 43 (an image-receiving sheet) inserted between the platen roller 41 and the heat generating region 21 in the auxiliary scanning direction S2 perpendicular to the primary scanning direction S1, by the rotation of the platen roller 41. Along with the movement of the thermal sheet 43, the plurality of heat generating resistors 18 is selectively heated to form a desired image.

At the time of printing, the platen roller 41 presses the thermal sheet 43 against the heat generating resistor 18. By rotating the platen roller 41 in the auxiliary scanning direction S2, printing on the thermal sheet 43 is performed by heat generated from the heat generating resistor 18.

When the platen roller 41 rotates, a force for pushing the head substrate 13 in the auxiliary scanning direction S2 is exerted by friction. Although the head substrate 13 is fixed with an adhesive 23 such as a double-sided tape, when the pressing force of the platen roller 41 is high, the head substrate 13 slightly repeatedly moves in accordance with the rotation of the platen roller 41.

The reason why the head substrate 13 repeatedly moves is that, while the platen roller 41 is rotating, the head substrate 13 is shifted to the side of the auxiliary scanning direction S2, and when the platen roller 41 stops, the head substrate 13 returns to the original position.

As a result, in some cases, a repeated load is applied to the bonding wire 24, and the bonding wire 24 may be fatigued and fractured. There is a high probability that the location at which the fracture occurs may be the bonding neck portion of the driving IC 15 side to which the bonding wire 24 is connected and the bonding wire neck portion connected to the head substrate 13 side.

Figure 7:
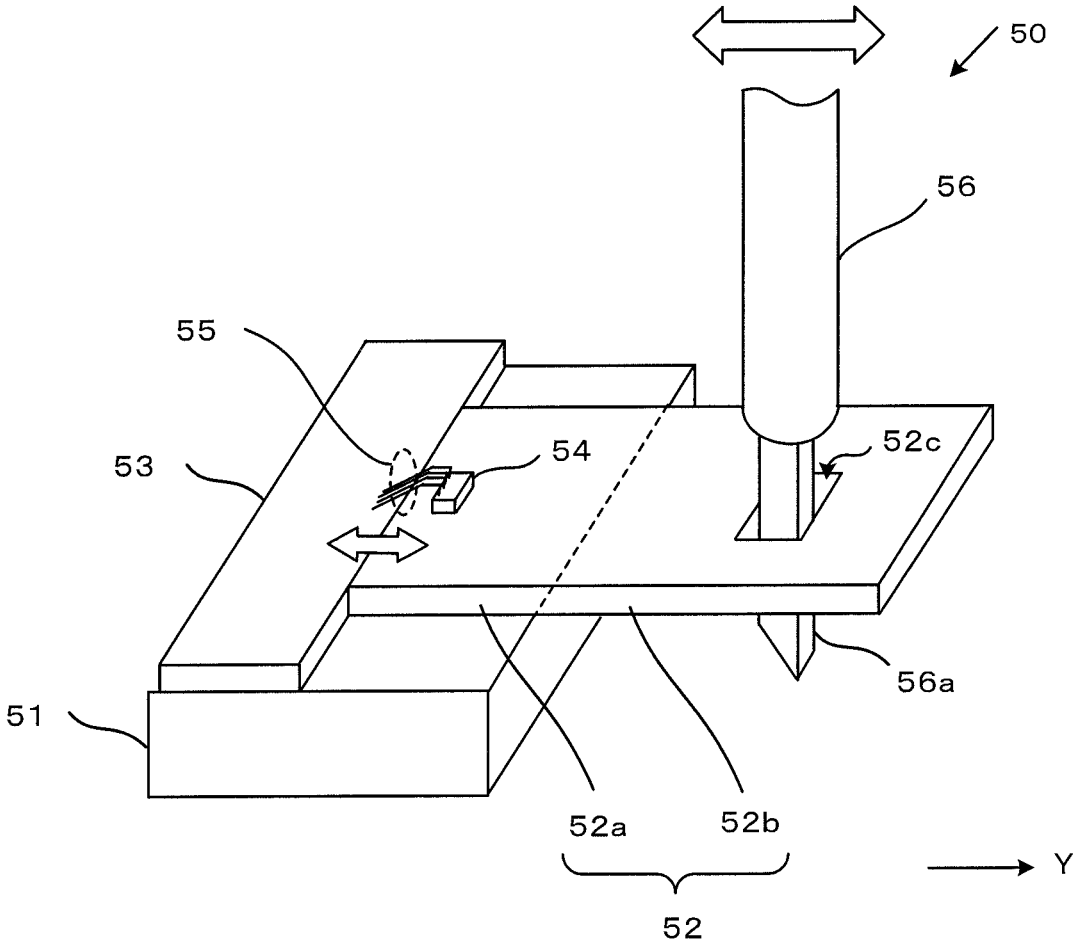
FIG. 7 is a diagram to describe a method of measuring fatigue fracture characteristics due to repetitive substrate movement according to the first embodiment.
Figure 8:
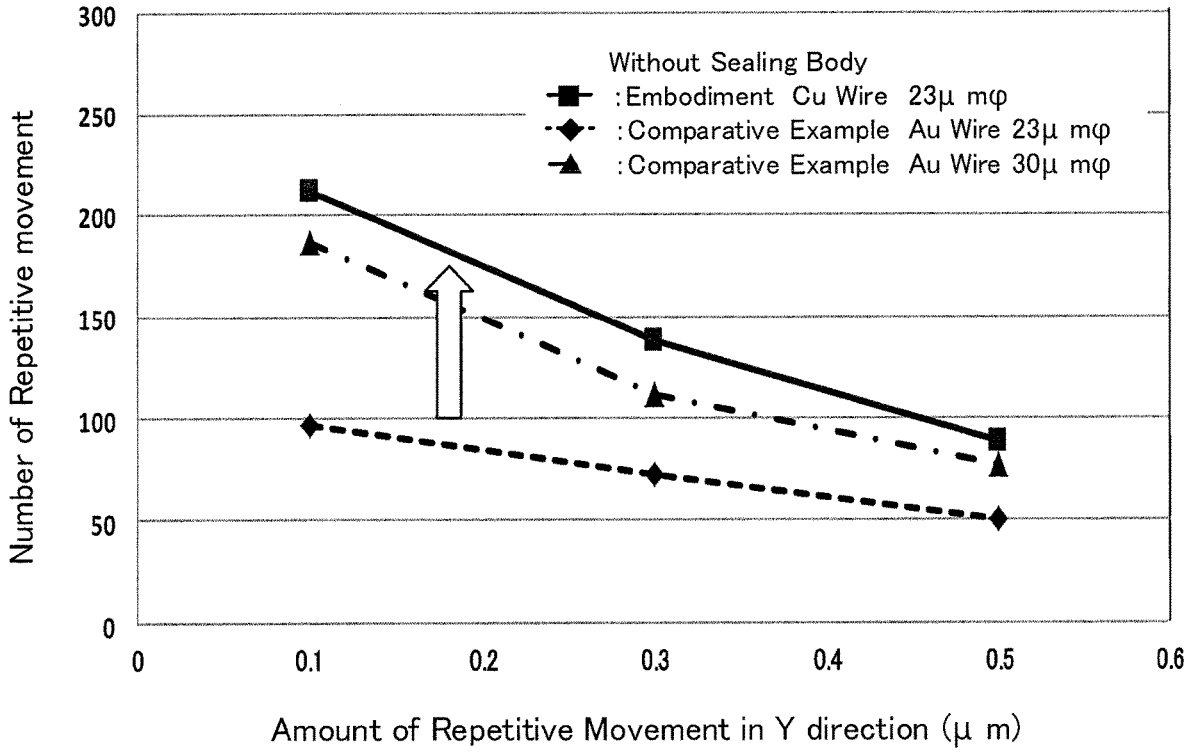
FIG. 8 is a view illustrating the fatigue fracture characteristic of the bonding wire due to the repetitive substrate movement according to the first embodiment in comparison with the bonding wires of the comparative example.
Figure 9:
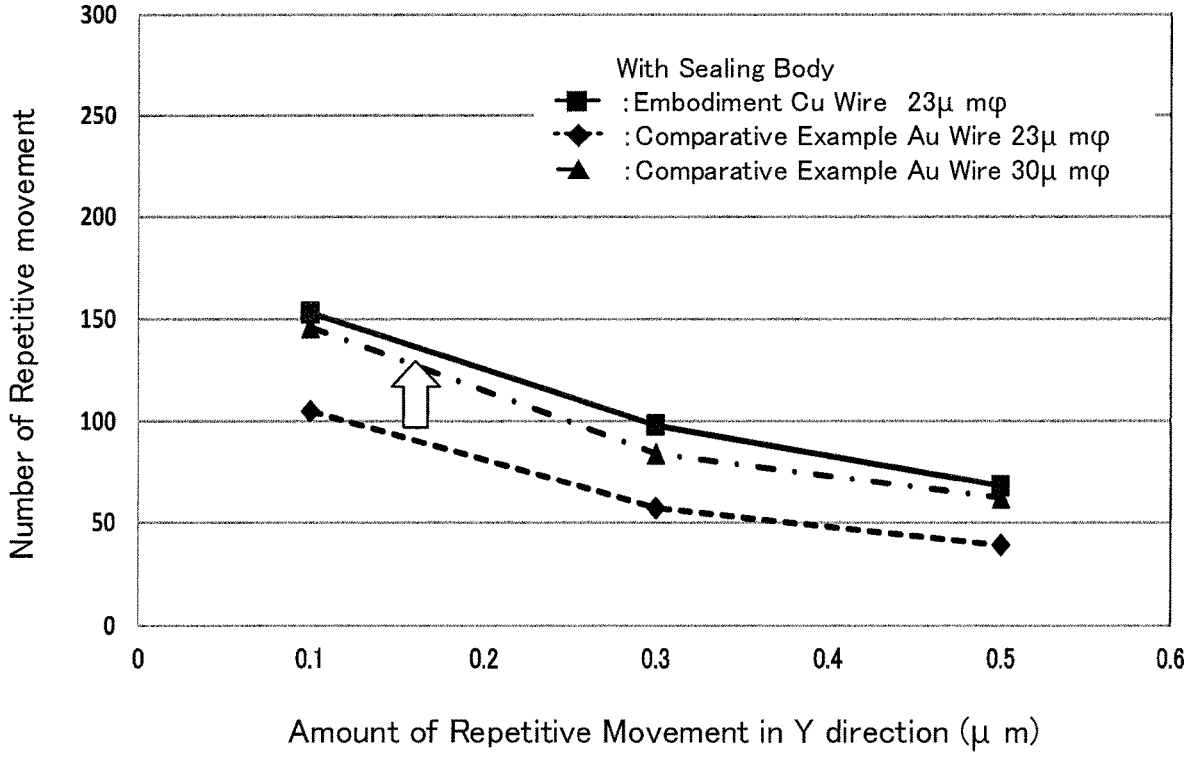
FIG. 9 is a view illustrating the fatigue fracture characteristic of the bonding wire due to repetitive substrate movement according to the first embodiment in comparison with the bonding wires of the comparative example.

With reference to FIGS. 7 to 9, the fatigue fracture characteristic due to repetitive movement of the head substrate 13 will be described in comparison with the bonding wire of the comparative example. FIG. 7 is a view to describe a method of measuring fatigue fracture characteristics due to the repetitive movement of the head substrate 13, and FIGS. 8 and 9 are views illustrating fatigue fracture characteristics.

Measurement of fatigue fracture characteristics due to repetitive movement of the head substrate 13 was performed using an acceleration test apparatus configured to repeatedly move the substrate on which the object to be measured was mounted in a horizontal direction at a constant amplitude. The acceleration test apparatus will be briefly described.

As illustrated in FIG. 7, in the acceleration test apparatus 50, the first substrate 52 and the second substrate 53 are placed on the upper surface of the base substrate 51 so as to be adjacent to each other. The first substrate 52 and the second substrate 53 are fixed to the upper surface of the base substrate 51 by double-sided tape.

The first substrate 52 has a first portion 52*a* placed on the upper surface of the base substrate 51, and a second portion 52*b* extending in the horizontal direction (Y direction) from the base substrate 51. An opening 52*c* is provided in the second portion 52*b*.

The IC 54 is placed on the second substrate 53 side of the first portion 52*a* near the adjacent portion of the first substrate 52 and the second substrate 53. A bonding pad (not illustrated) of the IC 54 and a bonding pad (not illustrated) of the second substrate 53 are electrically connected to each other by a bonding wire 55.

A distal end portion 56*a* of a die shearing tool 56 is inserted through the opening 52*c*. By moving the die shearing tool 56 back and forth in the Y direction, the first substrate 52 on which the IC 54 is mounted repeatedly moves in the horizontal direction at a constant amplitude. As a result, since a repeated load is applied to the bonding wire 55, a fatigue fracture test of the bonding wire 55 can be performed.

The fatigue fracture test is obtained by an acceleration test of changing the amount of repetitive movement of the head substrate 13 in the auxiliary scanning direction S2 (Y direction) to 0.1 mm, 0.3 mm, and 0.5 mm, and counting the number of repetitive movements until the bonding wire 24 is fractured. Both the copper wire and the gold wire have a wire diameter of 23 μmϕ. In addition, a case where the diameter of the wire is 30 μmϕ only for the gold wire is added.

FIG. 8 is a view illustrating fatigue fracture characteristics in the absence of the sealing body 26, a solid line shows the fatigue fracture characteristics of the copper wire, and a broken line and a one-dot chain line show the fatigue fracture characteristics of the gold wire.

As illustrated in FIG. 8, in the absence of the sealing body 26, with respect to the amount of repetitive movement of 0.1 mm, 0.3 mm, and 0.5 mm, the 23 μmϕ gold wire is fractured when the number of repetitive movement is 97 times, 72 times, and 50 times, respectively. On the other hand, the 23 μmϕ copper wire was not fractured until the number of repetitive movements is 212 times, 138 times, and 89 times, respectively. The location in which the wire is fractured is a neck portion of a connection between the bonding wire 24 and the bonding pad 31 or the bonding pad 32.

By the way, when the diameter of the gold wire is set to 30 μmϕ, the number of repetitive movements of the 30 μmϕ gold wire approaches the number of repetitive movements of the 23 μmϕ copper wire in any of the amounts of repetitive movement of 0.1 mm, 0.3 mm, and 0.5 mm.

FIG. 9 is a view illustrating the fatigue fracture characteristics in the presence of the sealing body 26, a solid line shows the fatigue fracture characteristic of the copper wire, and a broken line and a one-dot chain line show the fatigue fracture characteristics of the gold wire.

As illustrated in FIG. 9, even when the sealing body 26 is present, a relation between the amount of repetitive movement and the number of repetitive movement is substantially the same as that of FIG. 8. The 23 μmϕ gold wire is fractured repeatedly when the number of repetitive movement is 105 times, 57 times, and 39 times, respectively, with respect to the amount of repetitive movement of 0.1 mm, 0.3 mm, and 0.5 mm. On the other hand, the 23 μmϕ copper wire is not fractured until the number of repetitive movement is 153 times, 98 times, and 68 times, respectively. The location in which the wire is fractured is generally the neck portion of the connection between the bonding wire 24 and the bonding pad.

By the way, when the diameter of the gold wire is set to 30 μmϕ, the number of repetitive movements of the 30 μmϕ gold wire approaches the number of repetitive movements of the 23 μmϕ copper wire in any of the amount of repetitive movement of 0.1 mm, 0.3 mm, and 0.5 mm.

These results indicate that the copper wire withstands repetitive movement almost twice as much as the gold wire irrespective of the presence or absence of the sealing body 26. In the gold wire, in order to obtain the same number of repetitive movements as the copper wire, it is necessary to set the wire diameter to be larger than 30 μmϕ.

Depending on the presence or absence of the sealing body 26, there is a difference in the number of repetitive movements. The number of repetitive movements when the sealing body 26 is absent is about 1.3 higher than the number of repetitive movements when the sealing body 26 is present. It is considered that free expansion and contraction of the bonding wire 24 is restricted by the sealing body 26 when the sealing body 26 is present. The sealing body 26 is necessary for protecting the driving IC 15 and the bonding wires 24, 25 from the external environment.

By using a copper wire as a bonding wire, it is possible to improve the strength of the neck portion of the connection between the bonding wire 24 and the bonding pads 31, 32.

It is possible to prevent fatigue fracture of the bonding wire 24 due to repetitive movement of the head substrate 13 in accordance with the rotation of the platen roller 41.

In the copper wire, since the wire tip is easier to bend and the deposit easily occurs as compared to the gold wire, bonding conditions are more difficult than the gold wire. To cope with the problem, it is preferable to use, for example, the wire bonding method illustrated in FIG. 10.

Figure 10:
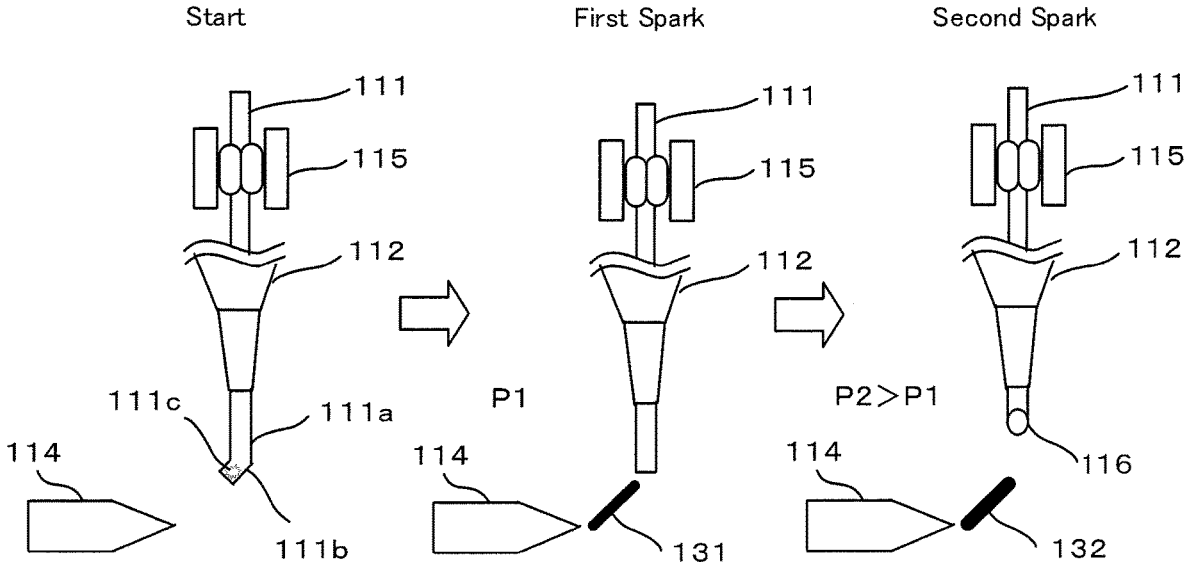
FIG. 10 is a diagram illustrating an example of a wire bonding method according to the first embodiment.

In the wire bonding method illustrated in FIG. 10, a first spark having a first energy is applied to a tail tip of a wire and then an initial ball is formed at a second step of applying a second spark having a second energy greater than the first energy.

As illustrated in FIG. 10, a wire 111 is inserted into a capillary 112. A first spark 131 having a first energy P1 is applied to the tip of the wire 111 inserted into the capillary 112 by an electric torch 114. As a result, a bent 111*b* of the tail 111*a* and a deposit 111*c* such as dissimilar metals are melted and removed, and the tail 111*a* is adjusted to an initial state.

A second spark 132 having a second energy P2 greater than the first energy P1 is applied to the tail 111*a* by the electric torch 114. As a result, the tail 111*a* adjusted to the initial state is melted, the melted tail 111*a* is rounded by surface tension, and a clean spherical initial ball 116 (Free Air Ball: FAB) is formed.

Thereafter, respective processes, such as a first bonding formation on the bonding pad 31 of the driving IC 15→a loop formation→a second bonding formation on the bonding pad 32→a stitch formation→a capillary ascent→a tail cutting, are performed as well as the ordinary wire bonding method.

Since the shape and size of the initial ball 116 are constant only by setting the first and second energy to preferable values in advance, the method of forming the initial ball in the copper wire in two steps enables the stable bonding of the copper wire.

Regarding the problem that the head substrate repeatedly moves in accordance with the rotation of the platen roller and the bonding wire leads to fatigue fracture, the measures described in the following (1) to (4) are considered, for example. (1) A stopper is provided so that the head substrate does not move, (2) a resin having a hardness higher than that of the silicone resin, such as an epoxy resin, is used for the sealing body of the bonding wire to prevent wire from moving in contrast to silicone resin, (3) the diameter of the bonding wire is increased to enhance the strength of the wire, and (4) the height of the loop of the bonding wire is increased. However, any of the measures of (1) to (4) also have problems such as an increase in expenses and manufacturing steps.

On the other hand, when using the copper wire of the embodiment as a bonding wire, shearing strength is increased even with the same wire diameter as that of the gold wire commonly used, and sufficient PULL strength is obtained. Thus, it is possible to eliminate the problem that the bonding wire is fractured by fatigue due to repetitive movement of the head substrate in accordance with the rotation of the platen roller.

As described above, in the thermal print head 10 of the embodiment, copper wires are used as bonding wires 24, 25. As a result, the shearing strength and the PULL strength of the bonding wires 24, 25 are improved as compared with the case of using gold wires.

In the thermal printer 40 using the thermal print head 10, it is possible to prevent fatigue fracture of the bonding wire 24 due to repetitive movement of the head substrate 13 in accordance with the rotation of the platen roller 41.

Therefore, it is possible to obtain a thermal print head having highly reliable bonding wires for repetitive movement of the head substrate due to rotation of the platen roller, and a thermal printer using the thermal print head.

In the embodiment, a case where a copper wire is used as the bonding wires 24, 25 has been described, but the same effect can be obtained by either the copper alloy wire or the metal wire containing copper as a main component.

Since basically no fatigue occurs on the bonding wire 25 with respect to repetitive movement of the head substrate 13 due to the rotation of the platen roller 41, the bonding wires 24, 25 do not necessarily need to be the wires of the same material and the same wire diameter.

Further, depending on the length of the bonding wire 24 and the like, all the bonding wires 24 do not necessarily need to be the copper wires.

However, when wires of different materials and different wire diameters are mixed, since the manufacturing process is complicated, it is needless to say that the bonding wires 24, 25 are desirably made of wire of substantially the same type (material and wire diameter).

A case where the image-receiving sheet is the thermal sheet has been described, but a plain sheet may be used as the image-receiving sheet. In that case, an ink ribbon is placed between the image-receiving sheet and the head substrate 13.

Second Embodiment

Figure 11A:
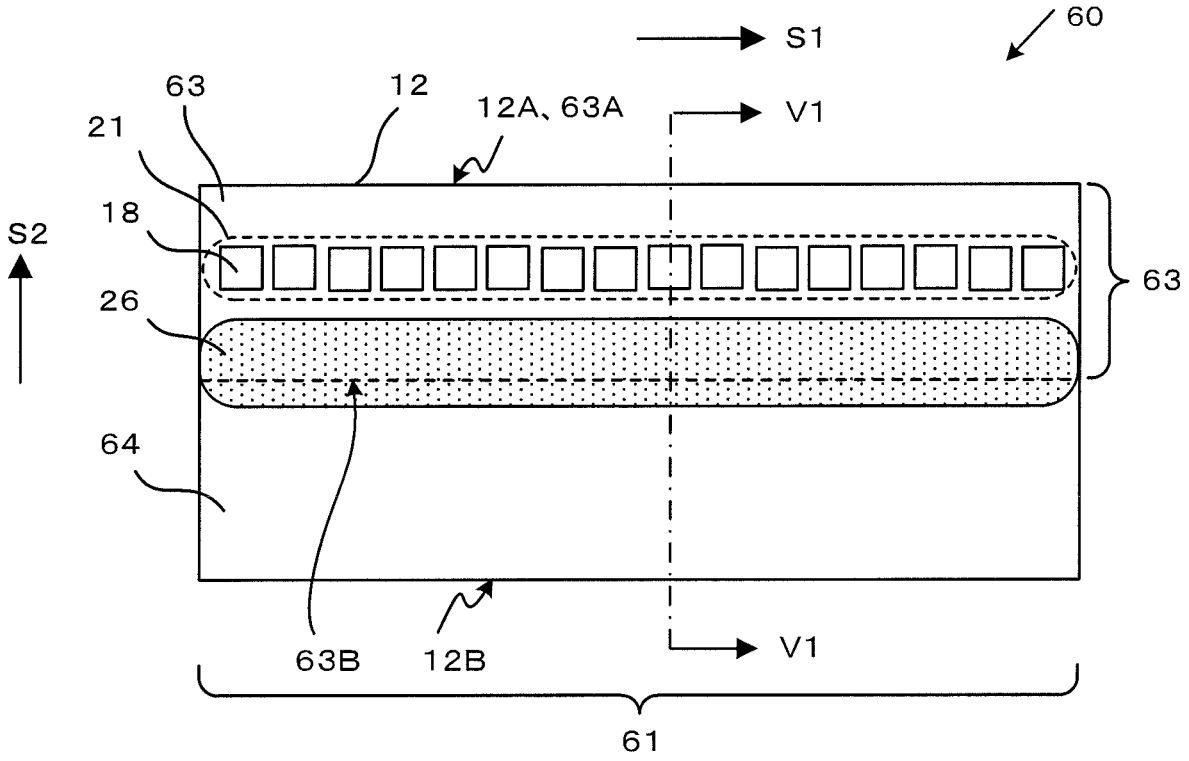
FIGS. 11A and 11B are diagrams illustrating a thermal print head according to a second embodiment.
Figure 11B:
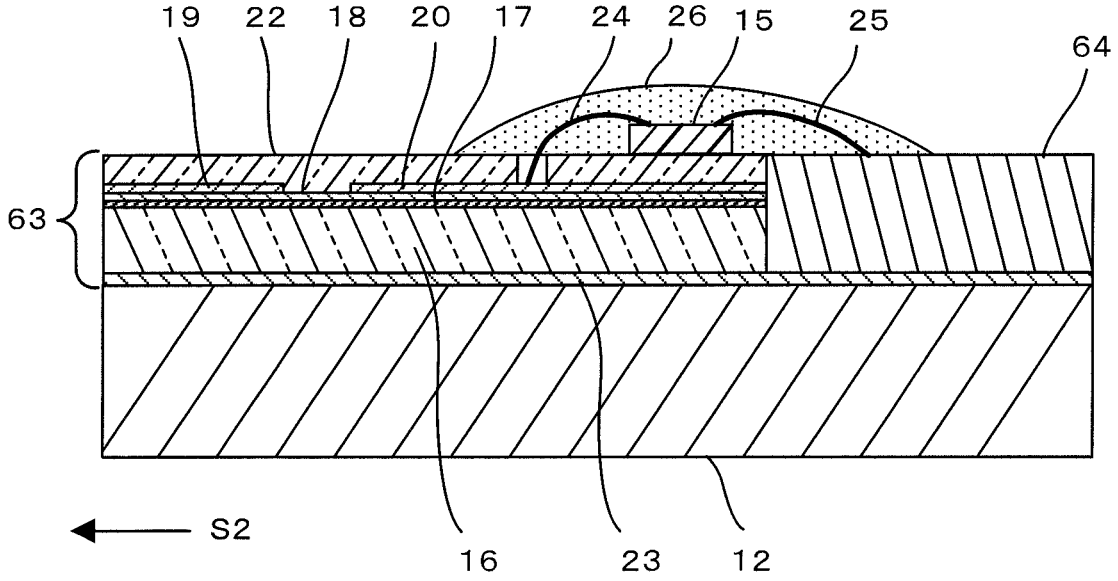

A thermal print head according to this embodiment will be described with reference to FIGS. 11A and 11B. FIGS. 11A and 11B are diagrams illustrating the thermal print head, FIG. 11A is a plan view of the thermal print head, and FIG. 11B is a cross-sectional view taken along line V1-V1 of FIG. 11A and viewed in a direction of an arrow.

In the embodiment, the same constituent portions as those of the above-described first embodiment are denoted by the same reference numerals, the description of the same portions will not be provided, and different portions will be described. This embodiment is different from the first embodiment in that the driving IC is placed on the upper surface of the head substrate close to the circuit board.

That is, as illustrated in FIG. 10, in the thermal print head 60 of the embodiment, a driving IC 15 is placed on an upper surface of a head substrate 63 close to a circuit board 64.

The head unit 61 has a head substrate 63 having a length in the auxiliary scanning direction S2 longer than that of the head substrate 13 illustrated in FIG. 1, and a circuit board 64 having a length in the auxiliary scanning direction S2 shorter than that of the circuit board 14 illustrated in FIG. 1. The length of the head unit 61 in the auxiliary scanning direction S2 is substantially the same as the length of the head unit 11 in the auxiliary scanning direction S2 illustrated in FIG. 1.

The plurality of driving ICs 15 is disposed, for example, at one end portion in the auxiliary scanning direction S2 on one surface of the head substrate 63 (that is, a boundary portion with the circuit board 64) in order in the primary scanning direction S1.

In the plurality of driving ICs 15, the plurality of first terminals is electrically connected to the corresponding individual electrodes 20 of the head substrate via the plurality of bonding wires 24 respectively. Further, in the plurality of driving ICs 15, the plurality of second terminals is electrically connected to the corresponding substrate electrodes (not illustrated) formed in the connection circuit of the circuit board 64 via the plurality of bonding wires 25 respectively.

The plurality of driving ICs 15 is sealed together with a plurality of bonding wires 24, 25 in the vicinity of a boundary between one surface of the head substrate 63 and one surface of the circuit board 64 by a sealing body 26 made of silicone resin.

In the thermal printer using the thermal print head 60, the head substrate 63 moves slightly repeatedly in accordance with the rotation of the platen roller 41. As a result, in some cases, a load is applied to the bonding wire 25, and the bonding wire 25 may be fatigued and fractured. There is a high probability that the position at which the fracture occurs may be the bonding neck portion of the driving IC 15 side to which the bonding wire 25 is connected and the bonding wire neck portion of the circuit board 64 side.

The bonding wires 24, 25 of the embodiment are copper wires and have higher shearing strength and PULL strength than those of gold wires as in FIGS. 3 to 5.

When using a copper wire as a bonding wire, it is possible to improve the strength of the neck portion of the connection between the bonding wire 25 and the bonding pads 33, 34. It is possible to improve the reliability of the bonding wire 25 against repetitive movement of the head substrate 63 in accordance with the rotation of the platen roller 41.

As described above, in the thermal print head 60 of the embodiment, the driving IC 15 is mounted on the upper surface of the head substrate 63 close to the circuit board 64, and copper wires are used as the bonding wires 24, 25.

Even in this embodiment, the bonding wires 24, 25 have shearing strength and PULL strength higher than those of gold wire.

As a result, in the thermal printer using the thermal print head 60, it is possible to prevent fatigue fracture of the bonding wire 25 due to repetitive movement of the head substrate 63 in accordance with the rotation of the platen roller 41.

Therefore, it is possible to obtain a thermal print head having highly reliable bonding wires for repetitive movement of the head substrate due to rotation of the platen roller, and a thermal printer using the thermal print head.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention. Moreover, above-mentioned embodiments can be combined mutually and can be carried out.

What is claimed is:

1. A thermal print head comprising:

a heat sink;

a head substrate having a support substrate placed on the heat sink, a glaze layer stacked on the support substrate, and a plurality of heat generating elements provided on the glaze layer and arranged in a primary scanning direction;

a circuit board placed on the heat sink so as to be adjacent to the head substrate in an auxiliary scanning direction and provided with a connection circuit; and a control element electrically connected to the heat generating element via a first bonding wire and electrically connected to the connection circuit via a second bonding wire, wherein at least one of the first bonding wire and the second bonding wire includes any of a copper wire, a copper alloy wire, and a wire mainly made of copper and coated with a metal different from copper, has a wire diameter of 18 μm or more and 23 μm or less, and is bonded with a long span of 0.5 mm to 3 mm.

2. The thermal print head according to claim 1, wherein the control element is placed on an upper surface of the circuit board close to the head substrate, the first bonding wire is any of a copper wire, a copper alloy wire, and a wire mainly made of copper and coated with a metal different from copper.

3. The thermal print head according to claim 2, wherein the first and second bonding wires are substantially the same kind of wires.

4. The thermal print head according to claim 2, further comprising:

a sealing body provided to cover the control element, the first bonding wire, and the second bonding wire, on an upper surface of the head substrate close to the circuit board and an upper surface of the circuit board close to the head substrate.

5. The thermal print head according to claim 4, wherein the sealing body is a resin having a hardness lower than a hardness of an epoxy resin.

6. The thermal print head according to claim 5, wherein the resin is a silicone resin.

7. The thermal print head according to claim 1, wherein the control element is placed on an upper surface of the head substrate close to the circuit board, the second bonding wire is any of a copper wire, a copper alloy wire, and a wire mainly made of copper and coated with a metal different from copper, and a wire diameter is 18 μm or more and 23 μm or less.

8. The thermal print head according to claim 7, wherein the first and second bonding wires are substantially the same kind of wires.

9. The thermal print head according to claim 7, further comprising:

a sealing body provided to cover the control element, the first bonding wire, and the second bonding wire, on an upper surface of the head substrate close to the circuit board and an upper surface of the circuit board close to the head substrate.

10. The thermal print head according to claim 9, wherein the sealing body is a resin having a hardness lower than an epoxy resin.

11. The thermal print head according to claim 10, wherein the resin is a silicone resin.

12. The thermal print head according to claim 1, wherein the first and second bonding wires are substantially the same kind of wires.

13. A thermal print head comprising:

a heat sink;

a head substrate having a support substrate placed on the heat sink, a glaze layer stacked on the support substrate, and a plurality of heat generating elements provided on the glaze layer and arranged in a primary scanning direction;

a circuit board placed on the heat sink so as to be adjacent to the head substrate in an auxiliary scanning direction and provided with a connection circuit;

a control element electrically connected to the heat generating element via a first bonding wire and electrically connected to the connection circuit via a second bonding wire; and a sealing body provided to cover the control element, the first bonding wire, and the second bonding wire, on an upper surface of the head substrate close to the circuit board and an upper surface of the circuit board close to the head substrate, wherein at least one of the first bonding wire and the second bonding wire includes any of a copper wire, a copper alloy wire, and a wire mainly made of copper and coated with a metal different from copper.

14. The thermal print head according to claim 13, wherein the sealing body is a resin having a hardness lower than a hardness of an epoxy resin.

15. The thermal print head according to claim 14, wherein the resin is a silicone resin.

16. A thermal printer comprising:

a thermal print head; and a platen roller to hold an image-receiving sheet with a plurality of heat generating elements and press the image-receiving sheet against the plurality of heat generating elements to move the image-receiving sheet in an auxiliary scanning direction, wherein the thermal print head comprises:

a heat sink;

a head substrate having a support substrate placed on the heat sink, a glaze layer stacked on the support substrate, and the plurality of heat generating elements provided on the glaze layer and arranged in a primary scanning direction;

a circuit board placed on the heat sink so as to be adjacent to the head substrate in an auxiliary scanning direction and provided with a connection circuit; and a control element electrically connected to the heat generating element via a first bonding wire and electrically connected to the connection circuit via a second bonding wire, wherein at least one of the first bonding wire and the second bonding wire includes any of a copper wire, a copper alloy wire, and a wire mainly made of copper and coated with a metal different from copper, has a wire diameter of 18 μm or more and 23 μm or less, and is bonded with a long span of 0.5 mm to 3 mm.

17. The thermal printer according to claim 16, wherein the control element is placed on an upper surface of the circuit board close to the head substrate, the first bonding wire is any of a copper wire, a copper alloy wire, and a wire mainly made of copper and coated with a metal different from copper.

18. The thermal printer according to claim 16, wherein the control element is placed on an upper surface of the head substrate close to the circuit board, the second bonding wire is any of a copper wire, a copper alloy wire, and a wire mainly made of copper and coated with a metal different from copper, and a wire diameter is 18 μm or more and 23 μm or less.

19. The thermal printer according to claim 16, wherein the first and second bonding wires are substantially the same kind of wires.

20. A thermal printer comprising:

a thermal print head; and a platen roller to hold an image-receiving sheet with a plurality of heat generating elements and press the image-receiving sheet against the plurality of heat generating elements to move the image-receiving sheet in an auxiliary scanning direction, wherein the thermal print head comprises:

a heat sink;

a head substrate having a support substrate placed on the heat sink, a glaze layer stacked on the support substrate, and the plurality of heat generating elements provided on the glaze layer and arranged in a primary scanning direction;

a circuit board placed on the heat sink so as to be adjacent to the head substrate in an auxiliary scanning direction and provided with a connection circuit;

a control element electrically connected to the heat generating element via a first bonding wire and electrically connected to the connection circuit via a second bonding wire; and a sealing body provided to cover the control element, the first bonding wire, and the second bonding wire, on an upper surface of the head substrate close to the circuit board and an upper surface of the circuit board close to the head substrate, wherein at least one of the first bonding wire and the second bonding wire includes any of a copper wire, a copper alloy wire, and a wire mainly made of copper and coated with a metal different from copper.

* * * * *